United States Patent [19]

Hansen et al.

[11] Patent Number: 4,510,733

[45] Date of Patent: Apr. 16, 1985

[54] METHOD AND AN APPARATUS FOR CLOSING PACKING BAGS FOR SLAUGHTERED POULTRY

[75] Inventors: Erik Hansen, Hörning; Heinrich W. Lambach, Horsens, both of Denmark

[73] Assignee: Brdr. Schur International A/S, Horsens, Denmark

[21] Appl. No.: 336,348

[22] PCT Filed: Apr. 28, 1981

[86] PCT No.: PCT/DK81/00044

§ 371 Date: Dec. 29, 1981

§ 102(e) Date: Dec. 29, 1981

[87] PCT Pub. No.: WO81/03160

PCT Pub. Date: Nov. 12, 1981

[30] Foreign Application Priority Data

Apr. 29, 1980 [DK] Denmark ..... 1832/80

[51] Int. Cl.[3] ..... B65B 31/00

[52] U.S. Cl. ..... 53/434; 53/436; 53/480; 53/512; 53/526; 53/370; 53/570

[58] Field of Search ..... 53/138 A, 258, 370, 53/417, 419, 433, 434, 436, 469, 502, 503, 504, 511, 512, 583, 480, 526, 570; 137/801; 251/155, 156

[56] References Cited

U.S. PATENT DOCUMENTS

| | | | |
|---|---|---|---|
| 2,519,115 | 9/1950 | Costakos | 251/156 |
| 2,946,166 | 7/1960 | Baxter | 53/258 X |
| 3,094,825 | 6/1963 | Bracey et al. | 53/512 |
| 3,965,646 | 6/1976 | Hawkins | 53/512 |
| 3,971,191 | 7/1976 | Hoyland | 53/258 X |
| 4,035,982 | 7/1977 | Paules | 53/417 |
| 4,141,194 | 2/1979 | Rochman | 53/138 A X |
| 4,352,263 | 10/1982 | Andrews | 53/436 |

*Primary Examiner*—Robert L. Spruill
*Assistant Examiner*—Steven P. Weihrouch
*Attorney, Agent, or Firm*—Antonelli, Terry & Wands

[57] ABSTRACT

Slaughtered poultry, which has already been headwise introduced into a plastic bag member, is placed in a holder with a mouth of the plastic bag member being oriented upwardly. Two upper pivotal jaws are moved together to form a narrow cylinder about an upper end of the poultry, an overlying tubular member is forced down into a narrow cylinder for pressing the leg ends of the poultry downwardly, with the piston having a bottom closure which is active as a piston end but openable to enable a free bag mouth portion to be drawn into the tubular piston when vacuum is applied to the upper ends thereof. When the bottom closure is thereafter closed, the drawn up bag mouth portion will be clamped to the piston and the piston is rotated for twisting the bag mouth portion. Thereafter, the bag holder is moved past a tape applicator device for fixing of the twist bag mouth portion, with the bag portion outside of the tape being cut off and drawn away through the piston.

9 Claims, 8 Drawing Figures

METHOD AND AN APPARATUS FOR CLOSING PACKING BAGS FOR SLAUGHTERED POULTRY

The present invention relates to a method and an apparatus for closing sales bag packings of slaughtered chickens or other poultry. For the production of such packings it is a condition that the chickens be compacted prior to the final closing of the bags, viz. by forcing the leg ends of the chicken forwardly towards the head end of the chicken for reducing the length of the chicken and causing the thighs to be bent, whereby the packing is made compact and yet ample. This compacting operation should be effected just prior to the closing of the bag, for fixing the final shape of the chicken by means of the closed bag itself, and trained packers may effect the desired compaction in an easy and rapid manner in direct connection with a manual closing of the bags. However, the same operations have been very difficult to effect in an automatic manner without damaging the chickens.

The bags should fit rather closely about the chickens, and the leg ends should be pressed forwardly already when the chicken is introduced—headwise—into the bag. As illustrated, for example, in British Patent Specification No. 1,525,559, methods already have been developed for automatically filling the chickens into the bag members, but so far it has not been possible to develop a satisfactory bag closing method for practical use in direct connection with the chicken being introduced into the bag. The result is that in general the vast amount of bag chickens as produced all over the world have been closed manually, irrespectively of the bags having been filled manually or automatically.

The purpose of this invention is to provide a method and an apparatus usable for closing the bags in a simple and advantageous manner once the chickens have been placed in the bags.

The basic principle of the invention is that the open plastic bag with the chicken is placed in a holder with the leg ends of the chicken and the open end portion of the bag member located or collected in a relatively narrow tubular portion of the holder, whereafter a piston is introduced into this portion for compacting the chicken as required. The piston is then replaced by or even converted into a vacuum tube which sucks the bag mouth portion straight outwardly from the bag member, and the mouth portion is clamped by or to a surrounding, rotatable twisting member, which may even be constituted by a clamping device on the vacuum tube, and which is rotated so as to cause the bag mouth portion to be twisted just outside the rump end of the compacted chicken. Thereafter the twisted and constricted bag portion is fixed e.g. by means of adhesive tape.

Various details of the method and system according to the invention may be designed so as to enable a given apparatus to handle chickens of various sizes in the required effective and lenient manner and with high capacity.

Figure 1:
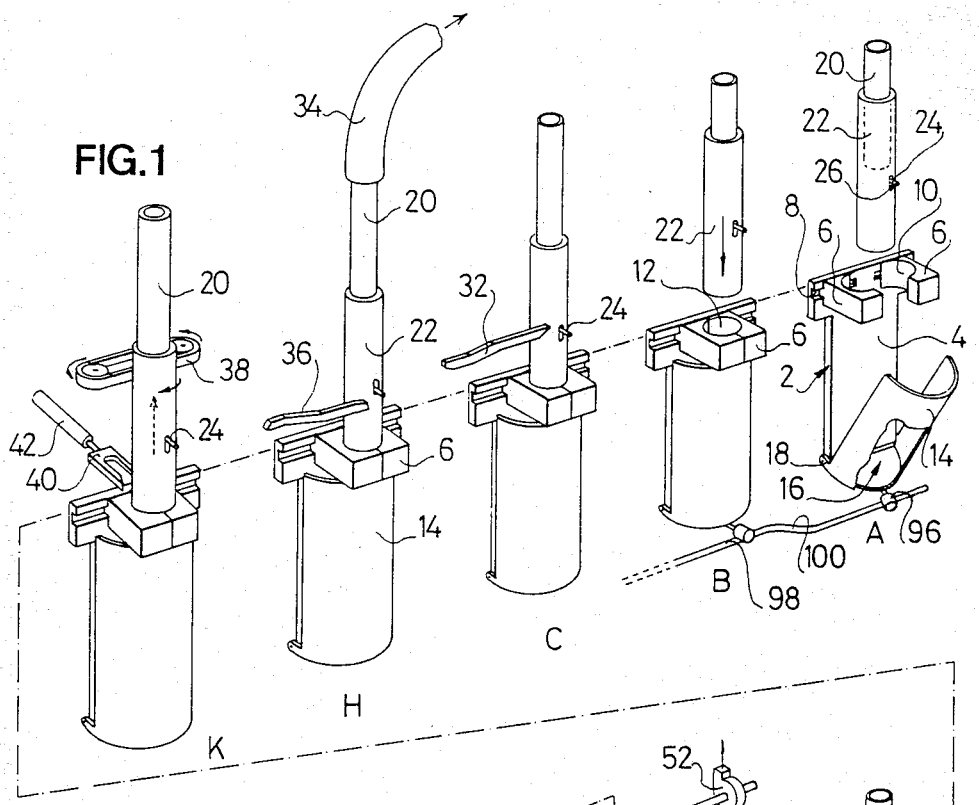
Figure 1:
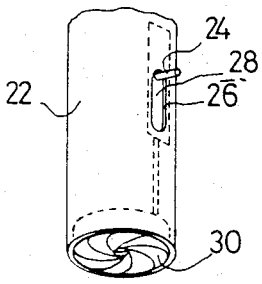
Figure 2:
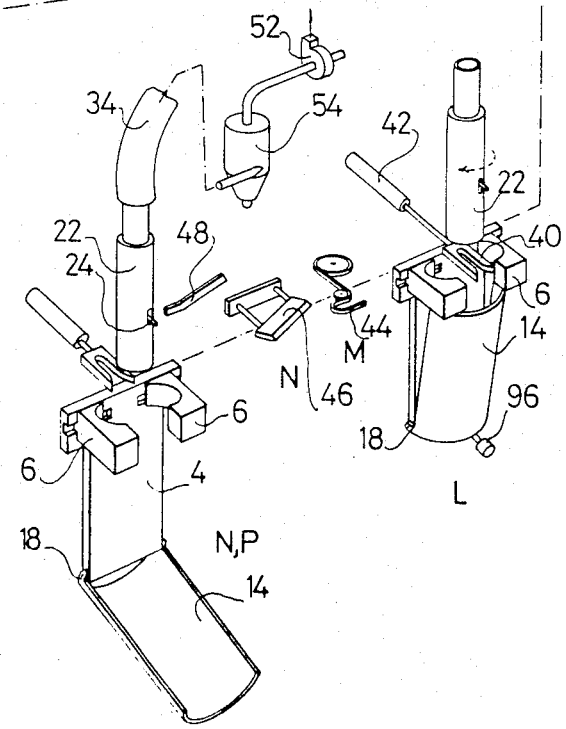
Figure 3:
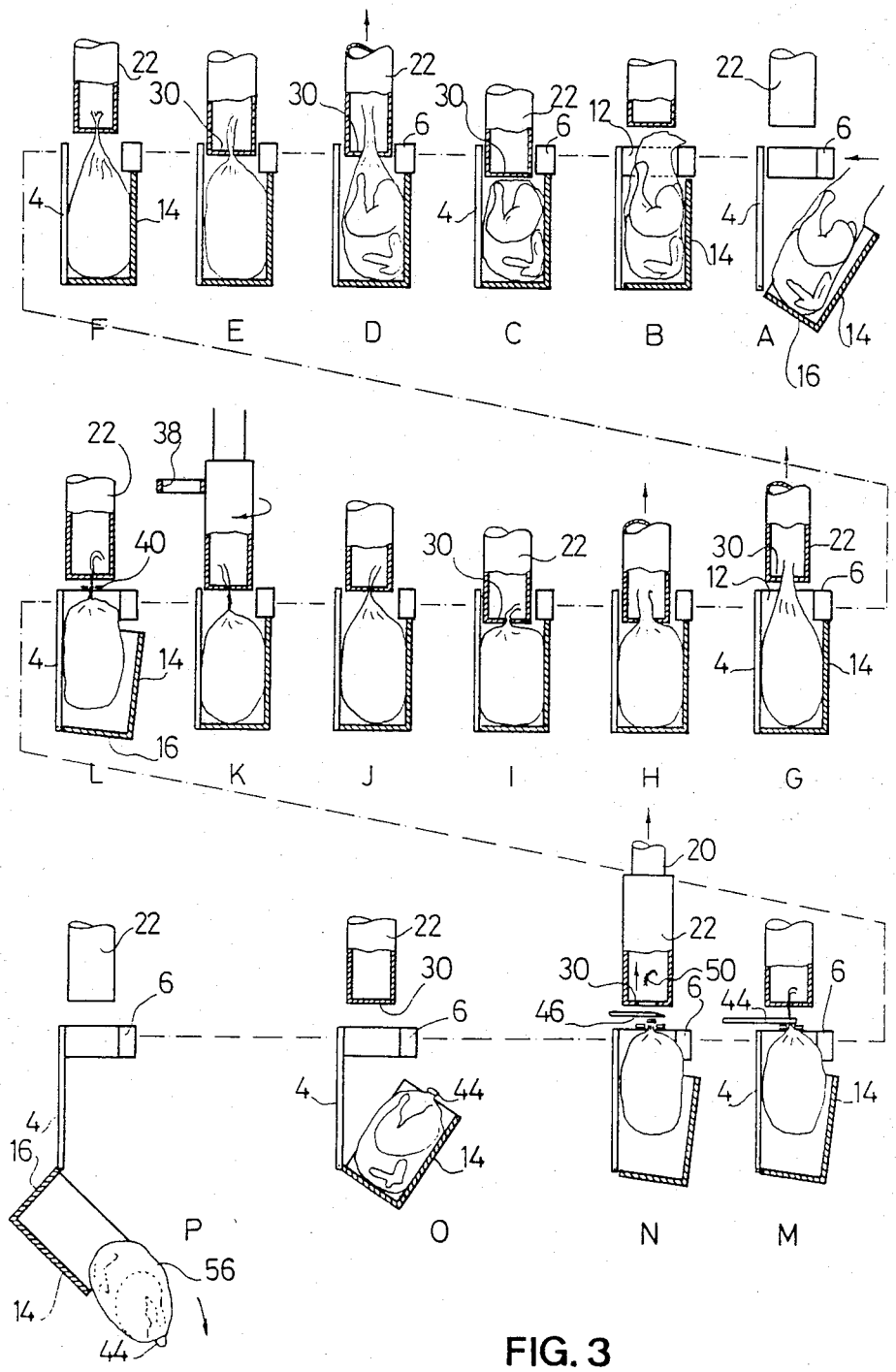
Figure 4:
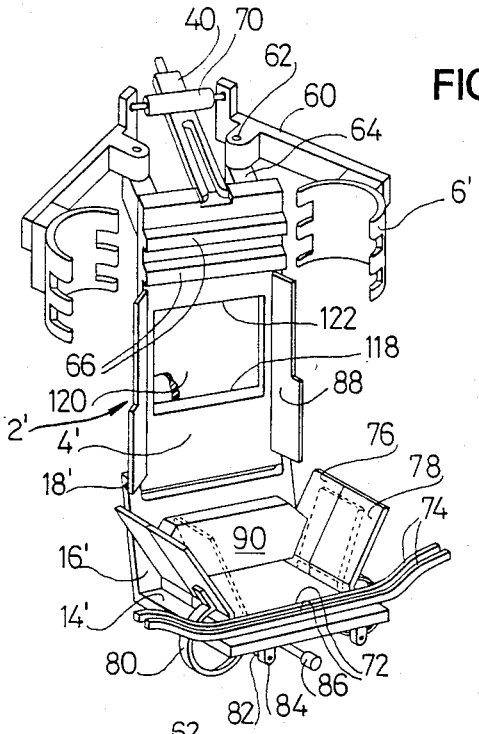
Figure 5:
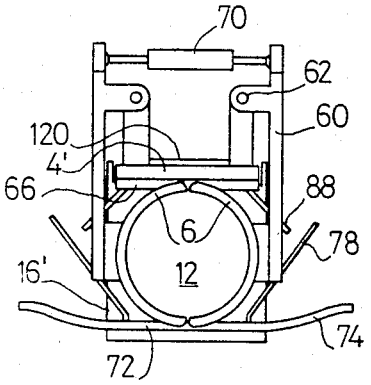
Figure 6:
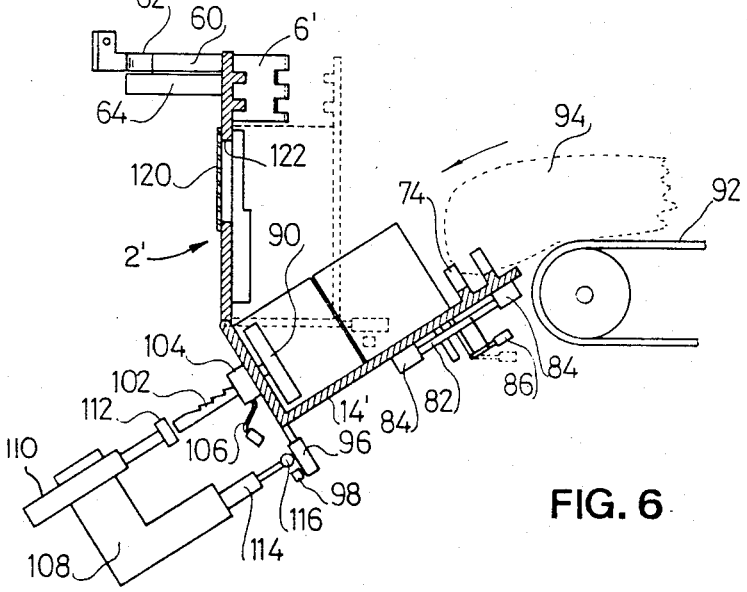
Figure 7:
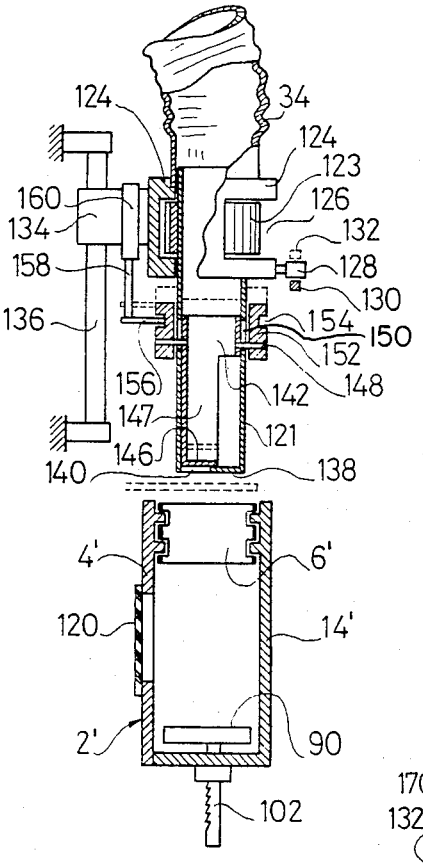
Figure 8:
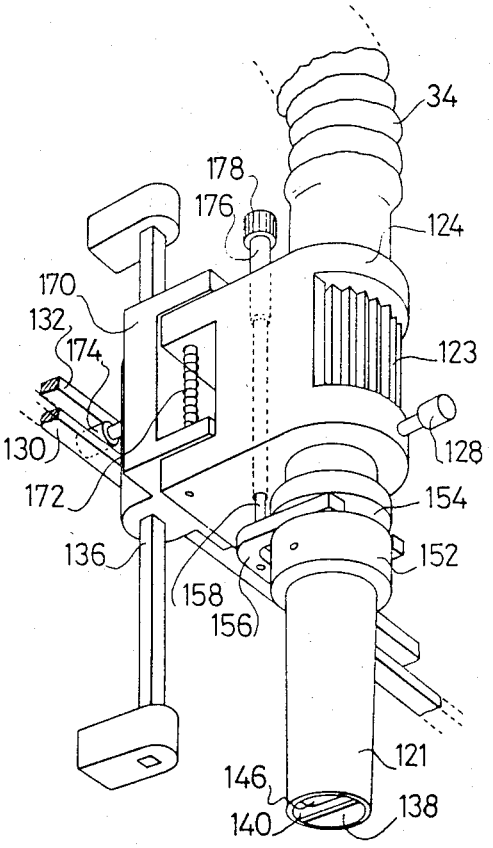

The invention is described in more detail in the following with reference to the accompanying drawings, in which:

FIG. 1 is a schematic perspective view illustrating the main steps of a method according to the invention, FIG. 2 is a perspective view of the lower end of a piston element as used therein, FIG. 3 is a schematic lateral view illustrating the various steps of the method in more detail, FIG. 4 is a perspective view of a preferred bag holder, FIG. 5 is a top view of the closed bag holder, FIG. 6 is a lateral sectional view of the same bag holder shown in an open receiving position, FIG. 7 is a sectional view of the bag holder and its associated piston arrangement, and FIG. 8 is a perspective view of the piston arrangement according to a preferred embodiment of the invention.

FIG. 1 shows a bag holder generally designated by the reference numeral 2 in various positions during the operation cycle of an apparatus according the invention, starting from the upper right hand corner of the figure (position A). The bag holder comprises a vertical rear plate member 4 which, at a top side thereof, is provided with a pair of forwardly protruding jaw members 6 slidably held by horizontal slide tracks 8 in the plate member 4 and provided with half circular recesses 10 facing each other such that the jaws 6, when moved together, form a block having a vertical bore 12, while, on the other hand, the jaws 6 are also retractable from one another as shown in position A of FIG. 1 Underneath the jaws 6, the front side of the plate member 4 is covered or is coverable by a half cylindrical shell flap 14 which has a bottom plate 16 and is hinged at 18 to the lower ends of the opposite side edges of the plate member 4 such that it is pivotal between the various positions shown in FIG. 1.

Above the bag holder 2 is mounted a telescopic tube arrangement comprising an upper stationary tube 20 and a lower tube 22, which is both axially slidable and rotatable relative the tube 20 and is in alignment with the bore 12 as defined by the juxtaposed jaws 6. The tube 22 is provided with an actuator pin 24 projecting radially through a vertical slot 26. As shown in FIG. 2 the pin 24 is mounted on an interior plate 28 covering the slot 26 and is operatively connected with a relatively heavy iris diaphragm mechanism 30 at the lower end of the tube 22 such that the iris is closed when the pin 24 is located adjacent the upper end of the slot 26 and is opened when the pin 24 is forced towards the lower slot end. This arrangement is shown schematically only, but it will be appreciated that there are many known mechanisms available for the purpose of a controlled closing and opening of a tube end such that the tube end presents either an at least partly closed surface suitable for use as a pressing piston end or an end opening of a substantial area suitable as a free air intake of a suction tube. Besides, a practical example of such an arrangement will be described below.

FIG. 1 may be representative of one bag holder 2 being processed successively through a number of operations or of several bag holders being present in various operation stations at the same time, the holders all being shifted from station to station during the operation of the apparatus. In a preferred embodiment there is arranged a plurality of bag holders 2 on a carrousel structure which is rotating in a continuous manner, with each bag holder 2 having its own overhead piston pipe system 20,22 likewise mounted on the carrousel structure. The complete apparatus further includes control means for effecting the various operations as described below, but since FIG. 1 is only schematically illustrative such further control means are shown therein to a limited degree only.

In position A of FIG. 1 the front flap 14 assumes an upwardly inclined position, in which a chicken loaded bag is receivable in the pocket space between the plate member 4 and the flap 14, the jaws 6 being retracted from each other so as to enable the top end of the bag to be moved into the space between the jaw recesses 10 when the flap 14 is closed against the plate 4. Thereafter (FIG. 1B) the jaws 6 are moved together so as to collect the bag mouth portion inside the bore 12. The height of the bag holder is chosen to suite the size of the chickens to be handled, such that also the outer leg portions of the chickens will be located inside the bore 12 with the bag mouth portion projecting further upwardly.

The position of the chicken in the bag and in the holder is shown in FIG. 3, which illustrates all the operations to be carried out for the closing of the bag according to a preferred method, while FIG. 1 shows only some of these operations. In position A the chicken bag may be filled into the holder manually or preferably automatically from the output end of an apparatus for putting the chickens into the bags, e.g., as disclosed in aforementioned British Patent Specification No. 1 525 559. In such an apparatus the leg ends of the chicken may already have been subjected to a forward pressure, whereby the chicken has been initially compressed into the shape shown in FIG. 3A, in which the leg ends project only slightly to the rear.

Once the holder is closed (position B) the piston tube 22 with its bottom iris 30 closed is moved downwardly to thereby gently compress the chicken by forcing down the leg ends as shown in position C. Thereafter, with reference to FIG. 3, the piston 22 is raised a little and the bottom iris 30 is caused to be opened, see position 3D. For opening the iris 30 it is sufficient to displace the actuator pin 24 downwardly, and according to FIG. 1C this may be done by means of a fixed cam member 32 arranged in the movement path of the holder and piston assembly.

In FIG. 1 the position following position C is designated H, but it corresponds closely to position D of FIG. 3. In this position, apart from the iris 30 being opened, the piston tube 22 is connected to a vacuum source through a hose 34 mounted on the top end of the upper telescopic tube 20. In the position D in FIG. 3, therefore, the suction through the opened end of the piston tube 22 will operate to suck into the tube end the loose top or mouth portion of the bag member in the holder; in position C the chicken was compressed regardless of this loose bag portion being clamped disorderly between the piston end and the chicken.

By means of another cam member 36, see FIG. 1H, the actuator pin 24 is then returned to close the iris 30 as shown in FIG. 3E. This closing will result in a material clamping of the bag mouth material as now sucked into the end of the tube 22.

According to the main principle of the invention the tube 22 could now be rotated, whereby the bag mouth material would be twisted and thereafter fixable e.g. by means of tape. In fact this is what is illustrated in FIG. 1: In position C the leg ends are pushed down by the piston 22, whereafter the piston iris 30 is opened by the cam 32 and the bag mouth is sucked into the piston tube in position H, whereafter the cam 36 causes the piston iris 30 to clamp about the bag mouth portion. In the next position, designated K in FIG. 1, the piston tube 22 is engaged by a driving belt 38 which is moved so as to cause the piston tube to rotate, whereby the bag mouth portion is twisted (see position K of FIG. 3). Thereafter, the piston tube 22 is lifted off the bore 12, thus exposing the twisted bag mouth portion, which is then fixed by means of tape as described below.

However, in the preferred method as illustrated in FIG. 3 further operations are included for increasing the packaging safety. Thus, after the position C the piston tube 22 is raised a little prior to or during the opening of the bottom iris 30 (position D) for increasing the safety with which the bag mouth portion is sucked into the tube 22. Thereafter the bottom iris 30 is closed in the slightly raised position of the tube (position E), and then the tube is further raised (position F) for mechanically pulling the bag mouth portion upwardly and stretching it for smoothing out possible folds in the sheet material.

Thereafter the bottom iris 30 is caused to be opened again (position G) to allow for suction air to be drawn into the tube 22, whereby the stretched out bag mouth portion will be supported and maintained when the piston tube 22 is thereafter lowered into the same height position as in position C, now see position H.

In this manner it is made sure that the area of the bag mouth portion as thereafter clamped by the bottom iris 30 (position I; after cam 36 in FIG. 1) is located closely above the chicken, without underlying folds in the bag material. When the bottom closure 30 of the piston tube 22 is suitably designed, e.g. as described later on, it may show a pressing piston action even in its open condition, and in position H of FIG. 3, therefore, the open piston may still show a certain compression effect on the chicken; this is desirable, because the folded legs of the chicken may well have straightend themselves somewhat out since they were compressed in position C, and it is important that the leg ends are pressed well forwardly (downwardly) immediately before the final closing of the bag. Already the iris closure 30 may show the desired piston effect even in its open condition, because it does not open to the full internal diameter of the piston tube 22.

Thus, in the position I, the bag mouth portion is mechanically gripped closely above the compacted chicken, and thereafter the piston tube 22 is raised a little (position J) to further stretch the bag material just above the chicken and prepare the bag for the following twisting in the position K as mentioned above with reference to FIG. 1.

Upon the twisting of the bag mouth material in position K three or four further operations may take place more or less simultaneously, as illustrated by position L of both FIGS. 1 and 3: (1) The front flap 14 of the bag holder is opened slightly to reduce its holding pressure on the chicken, (2) The jaws 6 are are moved away from each other, (3) The piston tube 22 is raised to above the top side of the jaws 6, and (4) A fork member 40 normally assuming a retracted position behind the bag holder is pushed forwardly just above the top edge of the plate member 4, e.g. by means of a working cylinder 42, whereby the twisted and constricted bag mouth portion is received in the space between the forks of this member 40 in the narrow space between the top edge of the plate member 4 and the lower end of the piston tube 22, crosswise of the moving direction of the bag holder 2.

During the further movement of the bag holder 2 the bag mouth portion will thus be firmly held between the end of the piston 22 and the fork member 40, and the portion located therebetween is now, in position M, brought into engagement with a tape loop applicator, which is illustrated schematically only, as such applicators are well known per se, with the tape being designated 44. Hereby the twisted bag portion is locked or fixed, and thereafter the bag holder 2 is moved past a cutting station N, in which the twisted bag portion is cut just above the tape loop. In FIGS. 1 and 3 the cutter means in the station N is shown as a stationary knife 46, but any other cutter means may be used, and in practice the cutting may be an operation integrated with the tape loop application.

Immediately after the cutting of the twisted bag portion the piston bottom iris 30 is opened, in FIG. 1 by means of a cam 48 engaging the actuator pin 24, whereby air is again sucked into the open piston end. The cut off bag portion, designated 50 in FIG. 3, position N, will thus be sucked away through the pipe 22, and as shown in the last position of FIG. 1 the vacuum hose 34 is connected to a vacuum source 52 through a separator 54 in which the cut off bag portions 50 are collected.

Thereafter the bottom iris 30 is again closed (position O, FIG. 3) and the front flap 14 is tilted forwardly and—according to position P—downwardly to a delivery position in which the final chicken packing 56 slides off the flap 14.

Then the front flap 14 is swung to an upwardly inclined position and is ready for receiving a new chicken, position A.

As shown in FIG. 4, a bag holder generally designated by the reference numeral 2', in an open condition, includes rear vertical plate 4 and a front flap 14 with a bottom portion 16' hinged at 18' to the lower end of the rear plate 4', principally just as in FIG. 1. Also half-cylindrical jaws 6' are used, though here they are mounted on levers 60 pivoted at 62 to respective rear brackets 64 adjacent the top edge of the plate 4'. The front top portion of the plate 4' is provided with horizontal ribs 66, and the jaws 6' are correspondingly provided with edge fingers 68 which, when the jaws 6' are swung together by suitable control means such as a cylinder 70, are moved along the groove spaces next to the ribs 66, with the tips of the fingers 68 being located generally behind the front plane of the ribs 66. Similar ribs 72 are provided on the inside of the top portion of the flap 14' for cooperation with fingers 68 at the outer edge portion of the jaws 6'. These ribs 72 may be provided with arched prolongations 74 outside the edges of the flap 14. Therefore, when the front flap 14 is swung to its closed position and the jaws 6 are thereafter swung inwardly it will be ensured that all of the loose mouth portion of the chicken bag will be collected between the jaws without any jamming thereof.

The front flap 14' is a plate member provided with diverging side wings 76. Outer prolongations 78 of the side wings 76 being constituted by separate plate members each mounted on one end of an arched carrier lever 80, the other end of which is pivotally secured to a shaft 82 rotatably held by a bracket 84 frontwise on the flap 14'. The two shafts 82 are operatively connected with an actuator member 86 operable to cause the shafts 82 to rotate so as to swing the plate members inwardly towards the positions shown in dotted lines. The actuator 86 is operated e.g. by suitable cam means, as soon as a new chicken has been received on the flap 14', whereby the chicken is adjusted to a correct orientation between the wing portions 78.

The rear plate 4' is provided with rigid wing portions 88 contributing to a suitable chicken holding cross section of the closed holder 2' underneath the tubular portion constituted by the jaws 6'. This will be apparent from the top view of the closed holder 2 as shown in FIG. 5.

For the practical operation of an apparatus according to the invention it will be highly advantageous if the chicken bag holders 2' are adjustable to various sizes of the chickens. In this connection the length of the chickens, i.e. the height of the chicken bags as placed vertically in the holder 2', is of major importance, because the leg ends of the chicken should be located reasonably accurately relative the level of the closed jaws 6'. On the flap bottom portion 16', therefore, there is mounted a bottom support member 90 which has a thickness complementary to the size of the chickens to be handled or which is adjustable with respect to its distance from the bottom plate 16. The support member may even be automatically adjustable as shown most clearly in FIG. 6.

In FIG. 6 the holder 2' is shown in its open receiving position, and it is located just outside the delivery end of a conveyor 92 serving to successively feed a chicken bag 94 to the bag holders 2' as passing the conveyor end. Frontwise on the bottom portion 16' of the flap 14' is mounted a protruding cam follower roller 96 which is normally rested on and along a fixed cam rail 98 serving to control the tilting movements of the flap assembly 14', 16'; this arrangement is also indicated in positions A and B of FIG. 1, where a sloping cam rail portion 100 is provided for causing the flap to close as it approaches position B. The bottom support member 90 is a separate element which is mounted on a shaft 102 passing through a lock bushing 104 at the middle of the bottom plate 16. The shaft 102 is provided with barb teeth which cooperate with a pawl lock in the bushing 104 such that when the shaft 102 is pushed upwardly it will be locked by the pawl against a relowering until a pawl release member 106 is actuated.

Thus, if a series of small size chickens is to be handled, the bottom support members 90 may be locked in a suitably raised position. In FIG. 6, which corresponds to position or station A of FIGS. 1 and 3, it is shown that in this station there is arranged, on a fixed support 108, an adjustment cylinder 110 having a piston rod with an outer shoe or rail member 112 which is operable to push the shaft 102 upwardly to any required position. The cylinder 110 may be remote controlled by an operator actuating a selector switch corresponding to the chicken size to be handled, or it may be automatically controlled in response to a size or weight detection of the single chicken as fed to the holder. To this end the support 108 may carry a pressure guage 114 having a sensor element with a free end rail portion 116 shaped as a rod member extending parallel with the cam rail 98 along a short length thereof and located so as to support the cam follower roller 96 just out of contact with the cam rail 98, whereby the clockwise momentum acting on the flap member 14,16 by the weight of the newly introduced chicken bag 94 will produce a pressure on the pressure guage 114 which is representative of the weight and therewith the size of the chicken. Therefore, the gauge 114 may be operatively connected with the cylinder 110 through suitable control means so as to cause the shoe or rail member 112 to raise the shaft 102 and the support member 90 to a position corresponding to the actual or individual size of the chicken.

When the bag holders 2' have passed the position N of FIG. 3 and before they return to position A, the pawl release member 106 may be actuated by engaging a fixed actuator means (not shown), such that the support member 90 of each holder 2' will be readjusted to assume its lowermost position before entering the receiving station A.

Once the height adjusted bottom support member 90 is used it may be used additionally for causing an extra compression of the chicken in the position H or I of FIG. 3, since it is possible to arrange in these positions or stations control means (not shown) for further raising the shaft 102 e.g. by one tooth thereof irrespectively of the shaft position of the arriving bag holders 2'. By way of example this operation may be electrically controlled, based on means for memorizing the original height setting of the shafts in the starting position A.

It has already been mentioned that the compressed folded legs of the chicken show an unfolding tendency as soon as the compression pressure is relieved. On this background it is a specific feature of the invention that means may be provided tending to retain or arrest the legs in their compressed positions as effected in the stations C and H-I of FIG. 3. These means simply consist of a rectangular opening 118 in the rear plate member 4' of the holder 2', see FIG. 4, this opening being covered rearwise by a rubber diaphragm 120, such that the opening 118 has an exposed upper edge 122. When the leg ends of the chicken are forced downwardly in the staion C, the outer leg portions will generally tend to move rearwardly inside the holder, and such a displacement is made possible by a certain yielding of the rubber diaphragm 120. Simultaneously, a part of the outer leg portions will snap behind or under the upper opening edge 122, whereby this edge will prevent the legs from returning to their less compressed positions when the piston pressure is thereafter relieved, and the same will happen in stations H,I.

The use of the rubber diaphragm 120 further involves that the holders 2' are still better usable for chickens of various sizes because of a certain inherent flexibility of the depth dimension of the holders.

Nevertheless, for further adaption to different groups of chicken sizes the effective depth dimension of the holders 2' may be adjustable by way of an adjustability of the spacing between the rear holder plate 4' and the front flap portion 14'. This is easily achievable, in a non-illustrated manner, by arranging for the front flap portion 14' to be displaceable relative the bottom plate 16' or with the use of an inner front flap plate portion mounted as held or backed by the front plate 14' with a variable spacing therefrom. The adjustable spacing means may include means for rendering the innermost plate portion resiliently displaceable towards and away from the front flap portion 14.

In FIG. 7 is shown a preferred arrangement of the piston system. The piston tube is designated 121, and adjacent its upper end it is provided with a pinion 123 which is axially supported by a surrounding carrier block 124 having in its front side a recess 126, through which another pinion or a toothed belt corresponding to the belt 38 of FIG. 1, position K, is engageable with the pinion 123 for rotating the piston tube. The upper vacuum hose 34 is connected direct to the top side of the carrier block 124, and the upper telescopic tube 20 of FIGS. 1 and 3 is here omitted. The piston tube 121 is carried and guided by the carrier block 124, and the lower end of the hose 34 is moved up and down as the piston tube is displaced axially.

The vertical movements of the piston tube 121 are controlled by means of a cam follower 128 mounted on the carrier block 124 so as to project from the lower front side thereof, with this follower cooperating with a guiding rail system comprising a lower rail 130 for generally carrying the block 124 and therewith the piston tube 121 through the required path, and an upper downwardly inclined rail portion 132 mounted along those portions of this path, in which the piston is forced downwardly for effecting its compression action on the chicken.

The carrier block 124 has a rear bracket 134 forming a bushing which is vertically slidably mounted on a guiding pillar 136 belonging to the said rigid carousel structure.

The closure means at the lower end of the piston tube of FIG. 7 is illustrated in a preferred design thereof, see also FIG. 8. It comprises a half circular bottom disc 138 rigidly secured to the tube end so as to leave open the remaining half 140 of the tube end. Inside the tube is arranged an axially slidable sleeve member 142 having a downwardly projecting portion 147, the lower end of which is provided with another generally half circular disc 146 oriented complementary to the fixed disc 138, but overlapping the same slightly along their common edge. The sleeve 142 is provided with opposed radial pins 148 projecting outwardly through vertical slots 150 in the tube 121 and connected with an outer bushing member 152, which is arranged vertically slidable on the tube 121 and is provided with an annular groove 154. This groove is freely rotatably engaged by a fork or ring member 156 connected with the piston rod 158 of a vertical control cylinder 160 mounted on the bracket 134.

It will be readily understood that with this arrangement the control cylinder 160 will be operable to raise and lower the movable bottom disc 146 even during rotation of the piston tube 121, and the raised position as shown in dotted lines will correspond to the iris structure 30 of FIGS. 1–3 being open for allowing an air intake, while the closed position is correspondingly a combined air stop valve position, active compression position and bag mouth clamping position.

With the use of the piston tube end as partly covered by the fixed disc 138, FIGS. 7 and 8, the air intake through the tube end will be restricted and nonsymmetrical, and for widening the effective air intake area it may be advantageous to cause the piston tube to rotate during the lowering thereof under suction conditions, e.g. as between the positions G and H in FIG. 3.

In practice it is even preferred to make use of a similar rotary "suction lowering" of the piston tube from position B of FIG. 3 until the piston end reaches a position slightly above the leg ends of the chicken, e.g. 2 cm below the top side of the jaws 6, such that the piston end is not closed until it is about to engage the leg ends, whereby it is largely avoided that the free bag mouth portion is wrinckled underneath the piston. Thereafter, since the bag mouth portion has now been seized by the piston end, it will be preferred to keep the piston end closed during the following upward movement, i.e. the piston end is not opened in position D of FIG. 3.

FIG. 8 shows a modification of the piston arrangement according to FIG. 7. The carrier block 124 is mounted on the pillar 136 through an additional carrier 170, relative which the carrier block 124 is downwardly displaceable against the action of compression spring means 172, as clearly illustrated. The carrier 170 is provided with a rear cam follower 174 cooperating with the two main cam rails, which are here mounted to the rear of the piston system.

Thus, the piston system will still be forced downwardly when moving along a downwardly sloping portion of the upper cam rail 132, and normally the piston tube 121 will be readily lifted and supported by the passage along an upwardly sloping or horizontal portion of the lower rail 130. However, when in stations L-M the bag with the twisted mouth portion is pulled upwardly by the piston tube it will then be ensured that the bag or the chicken is not damaged, should the lifting action of the rail 130 continue after the top end of the chicken packing having been brought into engagement with the underside of the fork member 40, because by further lift action of the carrier 170 the spring 172 will yield and allow the piston tube to maintain its position. In other words, the cam rail may be designed for causing sufficient lifting in every case without causing any damage in such cases, where maximum lifting is not required or definitely undesired. Again in other words, the final axial stretching of the bags will be almost uniform irrespectively of variations of the chicken sizes.

It will be noted that the cam follower 128 at the lower front side of the carrier block 124 of FIG. 7 has been retained in FIG. 8, although it is no longer used for the general raising and lowering control of the piston tube. The cam follower 128, however, is still usable for cooperation with special cam rail means arranged upwardly sloping locally along selected operation stations for ensuring that the piston tube 121 really is being lifted as required despite the presence of the spring 172. Thus, it is important that in station L of FIG. 2 the piston tube has been lifted off the jaws 6 sufficiently for the introduction of the fork member 40 underneath the piston, and correspondingly it is essential to avoid any material interference between the moving pistons and the stationary tape applicator and cutter means of stations M and N.

FIG. 8 shows the further modification that the fork member 156 operating the bottom closure of the piston tube 121 by its engagement with the rotary slide bushing 152 is actuated through a vertical rod 158 which is not a piston rod as in FIG. 7, but is a topwise screw threaded rod passing up through a bore in the carrier block and thereabove cooperating with a nut bushing 176 having a pinion 178 mounted at its top end. It will be readily understood that the fork member 156 and therewith the bottom closure of the piston tube 121 may be actuated by causing the pinion 178 to rotate one way or the other by means of suitable rack means placed along the relevant portions of the moving path of the piston systems.

In the preferred method according to the invention the chicken bag is handled in an upright position, but it will be within the scope of the invention to handle the packings with any other orientation thereof. Moreover, it will be appreciated that the method is not limited to the closing of chicken bags, since bags containing other types of articles may be closed in a corresponding manner.

We claim:

1. A method of closing bag packings for slaughtered poultry introduced head first into a flexible bag member comprising the steps of:

arranging the flexible bag member with the poultry therein in a bag holder means with an open mouth end of the bag member being at least located adjacent to a tubular portion of said bag holder means, introducing a tubular pressing piston means into said tubular portion, causing the free end of the open mouth end of the bag member to be sucked into an open end portion of said tubular piston means by effecting a suction therethrough, forcing said piston means against the leg ends of the poultry so that the leg ends are forwardly compressed in the flexible bag member, effecting a further suction action on the open mouth end of the bag member through said piston means, clamping the open mouth end of the bag member by clamping means located adjacent the front poultry engaging end of said piston means and rotating said clamping means relative to said bag holder means to twist said open mouth end of the flexible bag member outside said leg ends of the poultry, and fixing the twisted mouth end of the flexible bag member.

2. A method according to claim 1, further comprising the step of adjusting a distance between a poultry head engaged end of said bag holder means and an opposed tubular bag holder portion for receiving the leg ends of the chicken in accordance with at least one of a weight and size of the poultry.

3. Apparatus for closing bag packings for slaughtered poultry, the apparatus comprising a bag holder means for receiving a bag member in which the poultry is head first introduced, a tubular bag holder means for receiving an open bag mouth portion and a leg end portion of the poultry, a piston means operable to be introduced into said tubular bag holder means for compacting the poultry by pressing the leg ends of the poultry inwardly in the bag member so that the leg ends of the poultry are forwardly compressed, a suction tube means operable to be introduced into said tubular holder means for causing a portion of the open bag mouth projecting beyond a rump portion of the poultry to be sucked into an outer end of said suction tube means, clamping means for mechanically seizing the bag mouth portion at a short distance outside the rump portion of the poultry, and means for mounting said clamping means so as to be rotatable relative to said bag holder means to effect a twisting of the bag mouth portions so as to enable a fixation of the twisted bag portion.

4. An apparatus according to claim 3, wherein said bag holder means includes a rear plate means and a front plate means, means are provided for enabling a relative pivoting of the front and rear plate means so as to define an open bag receiving position and a closed operative position in which the poultry is held with the leg ends thereof located adjacent said tubular bag holder means, said tubular bag holder means including at least two radially movable members operable to be moved toward and away from each other for collecting the bag mouth portion therebetween.

5. An apparatus according to one of claims 3 or 4, wherein the bag holder means includes a support means for supporting the head end of the poultry, means are provided for adjusting said support means with respect to said tubular bag holder means, control means are provided for enabling a position of the support means to be adjusted in accordance with at least one of a weight and size of the poultry.

6. An apparatus according to claim 3, wherein said piston means includes a tubular member alignable with said tubular bag holder means, said clamping means includes a closure means provided at an end of said tubular member facing the bag holder means, said closure means being operable to be shifted between a first position forming a generally closed end surface portion of the tubular member to enable a pressing of the leg ends of the poultry by an axial displacement of the piston means, and a second position in which at least a partial area of the end surface portion of the tubular member is open, means for connecting an opposite end of the tubular member with a vacuum source to enable suction through said end surface portion of said tubular member when said closure means assumes said second position, whereby the bag mouth portion sucked into the tubular member by said suction is clamped to the piston means, and drive means for rotating said tubular member while the closure means is in said first position to thereby effect the twisting of the bag mouth portion.

7. An apparatus according to claim 6, wherein means are provided for permanently aligning said tubular member with said tubular bag holder means, and wherein a valve means is provided for permanently connecting said tubular member with a vacuum source.

8. An apparatus according to claim 7, wherein said clamping means includes a first cross plate member provided at one end of said tubular member for partially covering the end of the tubular member, a clamp member slidably arranged inside the tubular member, said clamp member having a second cross plate member partially closing the cross section of the tubular member and being operable to be shifted between an open position in which suction air can pass through the tubular member, and a closed postion in which the two cross plate members together substantially close the end of the tubular member whereby the bag mouth portion, upon being sucked into the end of the tubular member is clamped between the two cross plate members.

9. An apparatus according to claim 3, further comprising a bag closure fixing means for fixing the twisted bag mouth portion by suitable fixation means, and cutter means for cutting the bag mouth portion just outside the applied fixation means while the outer bag mouth portion is siezed by said clamping means.

* * * * *